US008389911B2

(12) United States Patent
Matsui

(10) Patent No.: US 8,389,911 B2
(45) Date of Patent: Mar. 5, 2013

(54) ELECTROMAGNETIC INDUCTION TYPE HEATING DEVICE, HOT AIR GENERATING DEVICE AND ELECTRICAL POWER GENERATING DEVICE

(76) Inventor: Tsugumitsu Matsui, Miyazaki (JP)

( * ) Notice: Subject to any disclaimer, the term of this patent is extended or adjusted under 35 U.S.C. 154(b) by 420 days.

(21) Appl. No.: 12/681,993

(22) PCT Filed: Oct. 7, 2008

(86) PCT No.: PCT/JP2008/068197

§ 371 (c)(1),
(2), (4) Date: May 12, 2010

(87) PCT Pub. No.: WO2009/048049

PCT Pub. Date: Apr. 16, 2009

(65) Prior Publication Data

US 2010/0219177 A1 Sep. 2, 2010

(30) Foreign Application Priority Data

Oct. 9, 2007 (JP) ..... 2007-289038
Jan. 18, 2008 (JP) ..... 2008-035287

(51) Int. Cl.
*H05B 6/02* (2006.01)

(52) U.S. Cl. ..... 219/600; 219/603; 219/651; 257/295; 257/421; 257/425

(58) Field of Classification Search ..... 257/421, 257/422, 423, 424, 425, 427, 428, 295, 396, 257/E21.006, E21.077, E21.084, E21.114, 257/E21.253, E21.479; 219/600, 603, 618, 219/624, 628, 630, 635, 651
See application file for complete search history.

(56) References Cited

U.S. PATENT DOCUMENTS

| | | | | |
|---|---|---|---|---|
| 5,726,838 | A * | 3/1998 | Soeya et al. | 360/327.32 |
| 6,468,199 | B1 * | 10/2002 | Satou et al. | 600/9 |
| 6,559,568 | B2 * | 5/2003 | Maejima et al. | 310/90.5 |
| 7,419,040 | B2 * | 9/2008 | Shiozaki et al. | 192/58.61 |

FOREIGN PATENT DOCUMENTS

| | | |
|---|---|---|
| JP | 2002-171775 | 6/2002 |
| JP | 2002-343541 | 11/2002 |
| JP | 2004-537147 | 12/2004 |
| WO | WO-03/053103 | 6/2003 |

* cited by examiner

*Primary Examiner* — David Nhu
(74) *Attorney, Agent, or Firm* — Jordan and Hamburg LLP

(57) ABSTRACT

Permanent magnets are arranged at the interior of a rotating body at uniform intervals. The device comprises: a rotating body which is rotated by a motor; a heat generation part, which is disposed in the vicinity of the rotating body, which includes an electroconductive material, and which is disposed within the magnetic fields of the permanent magnets; and a hot air capture plate, which is disposed in the vicinity of the heat generation part, and in which a plurality of hot air flow passage holes are provided, the rotating body being rotated by a rotating shaft, which is coupled to the motor. Furthermore, a thermocouple may be connected to the heat generation part, and the heat energy that would be dissipated to the outside air is converted to electrical energy by the thermocouple. Furthermore, the electromagnetic induction device is constituted such that a hot air capture plate, in which a plurality of hot air flow passage holes are provided, is disposed in the vicinity of the heat generation part.

7 Claims, 4 Drawing Sheets

ELECTROMAGNETIC INDUCTION TYPE HEATING DEVICE, HOT AIR GENERATING DEVICE AND ELECTRICAL POWER GENERATING DEVICE

REFERENCE TO RELATED APPLICATION

This application is a 371 of PCT/JP2008/068197, filed Oct. 7, 2008.

BACKGROUND OF THE INVENTION

The present invention relates to electromagnetic induction type heating devices, hot air generating devices and an electrical power generating devices, wherein hot air is generated as a result of Joule heating produced by generating an eddy current, using permanent magnets; more particularly it relates to electromagnetic induction type heating devices, hot air generating devices and electrical power generating devices, suitably employed as hot air generating devices, which use the hot air generated for heating greenhouses, for residential heating and for melting accumulated snow, and as power source devices, wherein some of the heat that is generated is reconverted to electrical power.

Conventionally, various different electromagnetic induction type heating devices have been proposed, which use induction heating methods in which an AC magnetic field is generated by an AC current. For example, in terms of induction heating devices comprising an electroconductive heated body and means for generating an AC magnetic field, an induction heating device has been proposed in which the heated body is rapidly heated by using a permanent magnet as means for generating a DC magnetic field and causing the DC magnetic field to act on the AC magnetic field (see Patent Document 1), and a heating device has been proposed in which a plurality of permanent magnets are disposed on the outer circumference of a rotor allowing for the generation of an eddy current (see Patent Reference 2) and the like.

Patent Document 1: JP-2002-343541-A

Patent Document 2: WO 2003/053103 A

SUMMARY OF THE INVENTION

However, the conventional devices described above were used for fixing toner in copiers and for drying/heating industrial materials, and the fact of the matter is that these are substantially never used as heat sources for ordinary households or as heating devices in the field of agriculture. The present invention is a reflection of the problems in the prior art such as described above, and an object thereof is to provide an electromagnetic induction type heating device, a hot air generating device and a electrical power generating device with a simple structure, which is useful as a high-efficiency, safe and economical heat source for ordinary households and in the field of agriculture.

In order to achieve the aforementioned objective, a first characteristic of the devices of the present invention is that of comprising: a rotatably provided planar rotating body, at the interior of which a permanent magnet is disposed; and a heat generation part that includes an electroconductive material, which is provided disposed in the vicinity of the planar rotating body, and which is disposed in the magnetic field of the permanent magnet; and a second characteristic thereof is that a thermocouple is connected to the heat generation part. Furthermore, a third characteristic of the present invention is that of comprising: a rotatably provided planar rotating body, at the interior of which a permanent magnet is disposed; a heat generation part that includes an electroconductive material, which is provided disposed in the vicinity of the planar rotating body, and which is disposed within the magnetic field of the permanent magnet; and a hot air capture plate, which is provided disposed in the vicinity of said heat generation part, and in which a plurality of hot air flow passage holes are provided. Furthermore, a fourth characteristic is that the hot air flow passage holes are arranged in a spiral. Moreover, a fifth characteristic is that a guide plate is provided in an upright manner, on the hot air capture plate, following along the arrangement of hot air passage holes. In addition, a sixth characteristic is that the hot air flow passage holes are formed with a taper that progressively narrows from the hot air inlet end towards the outlet end; and a seventh characteristic is that a thermocouple is connected to the heat generation part.

BRIEF DESCRIPTION OF THE DRAWINGS

FIG. 4(*b*) is a sectional front view, of a hot air capture part.

DETAILED DESCRIPTION OF THE INVENTION

Figure 1:
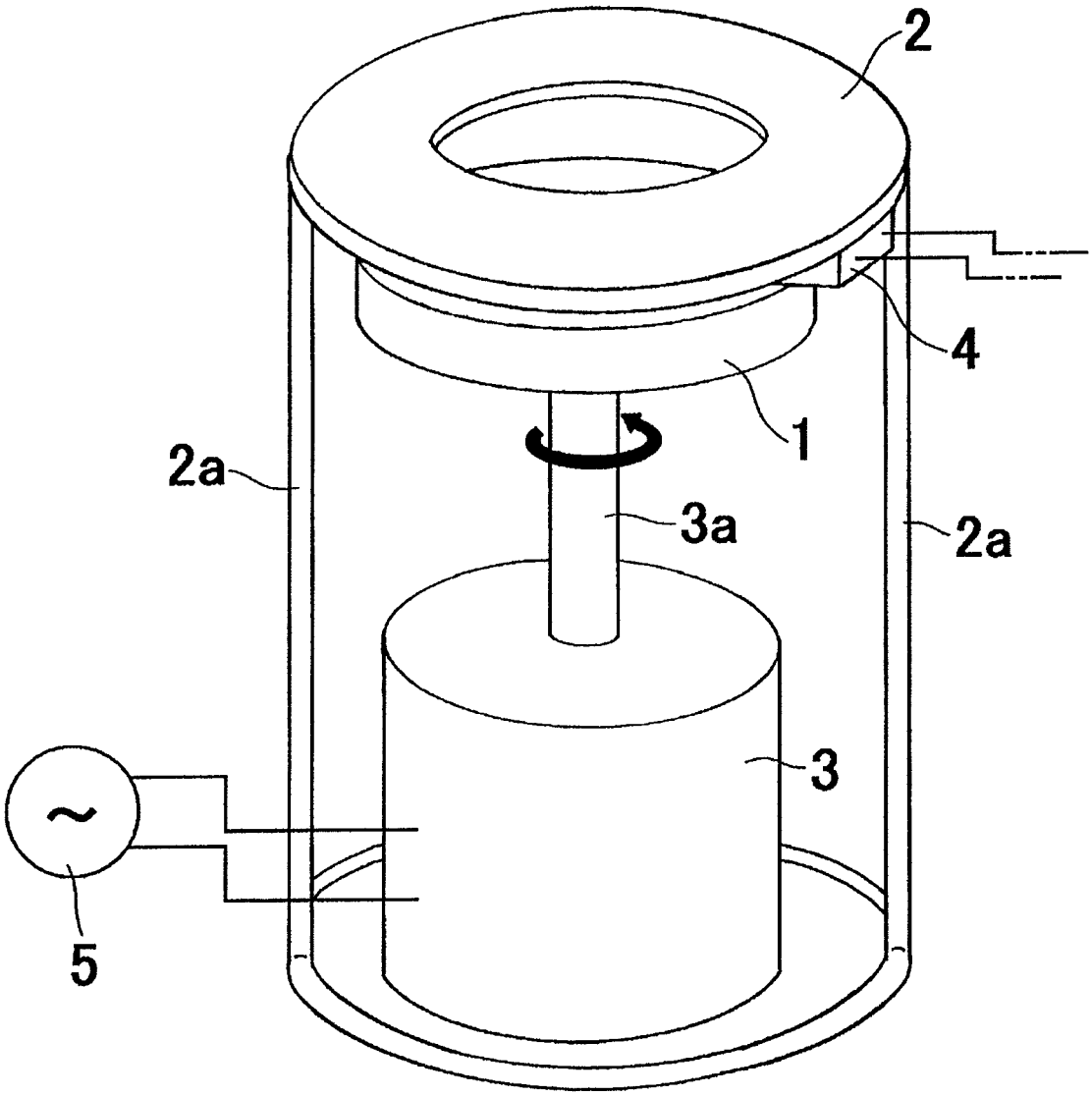
FIG. 1 is a perspective view showing one embodiment of an electromagnetic induction type heating device according to the present invention.

Hereinafter, the best modes for carrying out the present invention are described based on the embodiments shown in the drawings but, as a matter of course, the present invention is not limited to the embodiments.

In the present invention, as a result of rotating a planar rotor at high speeds, at the interior of which permanent magnets having strong magnetism have been disposed, in the vicinity of an electroconductive material such as a metal plate, north and south magnetic poles alternatingly cross the electroconductive material, resulting in the generation of an eddy current in the electroconductive material itself as a result of an electromagnetic induction phenomena, and this eddy current is converted to heat energy, so that the electroconductive material generates heat.

The electroconductive material is preferably selected from metals that are good conductors, such as copper, silver, aluminum and stainless steel, which readily generate eddy currents as a result of magnetism.

Preferably, permanent magnets of 3000 gauss or more at their surfaces such as, for example, neodymium magnets or samarium magnets, are used for the permanent magnets. The stronger the magnetism of the permanent magnet, the higher the temperature of the heat generated by the electroconductive material. The permanent magnets are rotated around the electroconductive material at several hundred RPM or more. The strength of the permanent magnets, the number of poles and the rotational speed are determined according to the amount of heat generation required and the usage. The temperature of the generated heat can easily be adjusted by adjusting the rotational speed of the rotor.

Embodiment 1

Figure 2:
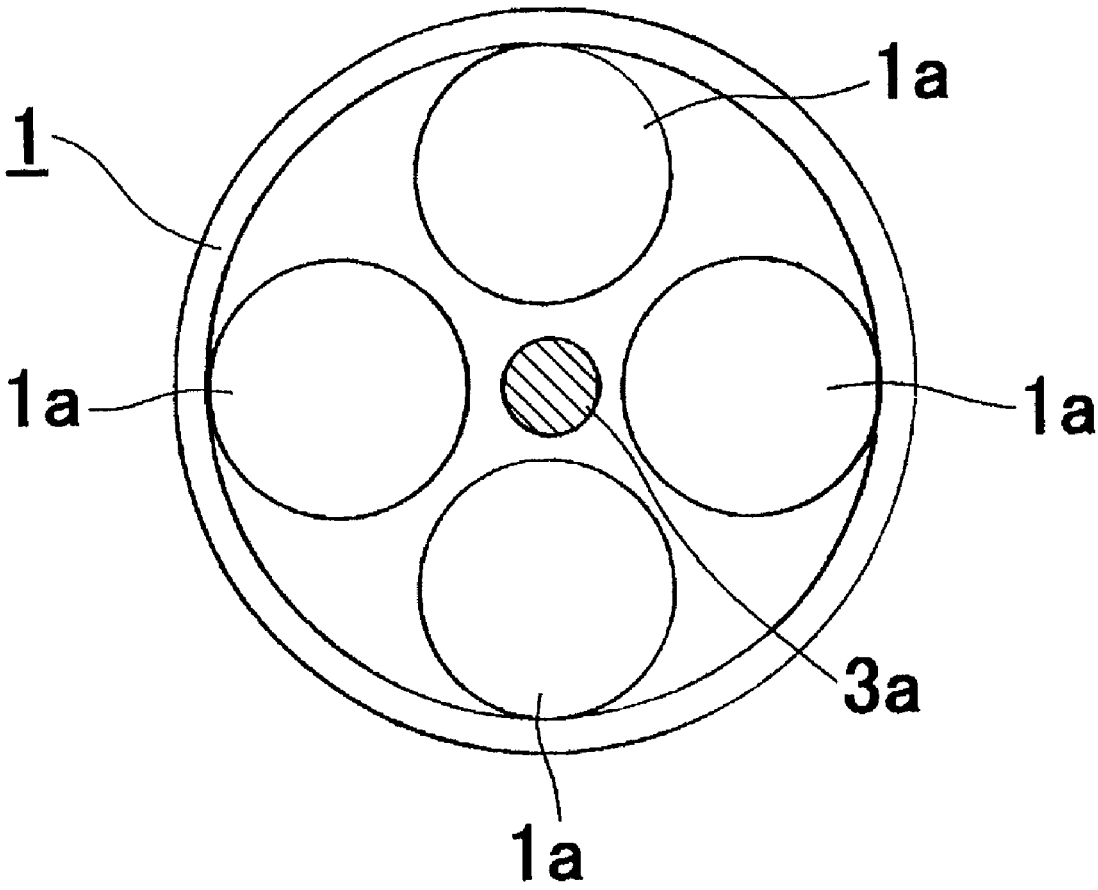
FIG. 2 is a view showing the arrangement of permanent magnets in a rotating body.

FIG. 1 is a perspective view showing one embodiment of an electromagnetic induction type heating device according to the present invention; and FIG. 2 is a view showing the arrangement of permanent magnets in the rotating body.

The heat generating device of the present invention is such that a heat generation part 2 embodied as an annular disk made from aluminum is disposed so as to be fixed in place upright by means of leg supports 2*a*, above and in the vicinity of (25 mm in the present embodiment) a planar rotating body 1, on which a plurality of permanent magnets 1*a* are fixed in place at arbitrary intervals.

The permanent magnets 1*a* are arranged in a circle on the rotating body 1 at uniform intervals. The permanent magnets 1*a* may be arranged so that north poles and south poles are alternatingly positioned, or may be arranged so that like poles are adjacent to each other. The number thereof disposed is likewise arbitrary. The rotating body 1 is rotated at high speeds by way of a rotating shaft 3*a*, which is coupled to a motor 3. Note that, in the present embodiment, the power source of the motor 3 is a commercial power source 5 but, as a matter of course, it is advantageous to use natural energy such as solar power, hydroelectric power or wind power as the power source.

Furthermore, by connecting a thermocouple 4 to the heat generation part 2, heat energy that would be dissipated to the outside air can be reconverted to electrical energy. As a matter of course, the electric power produced by this thermocouple 4 may be supplied via a step-up means or the like, as electrical power to be used by the motor 3, and may be used as a power source for other electrical equipment.

Embodiment 2

Figure 3:
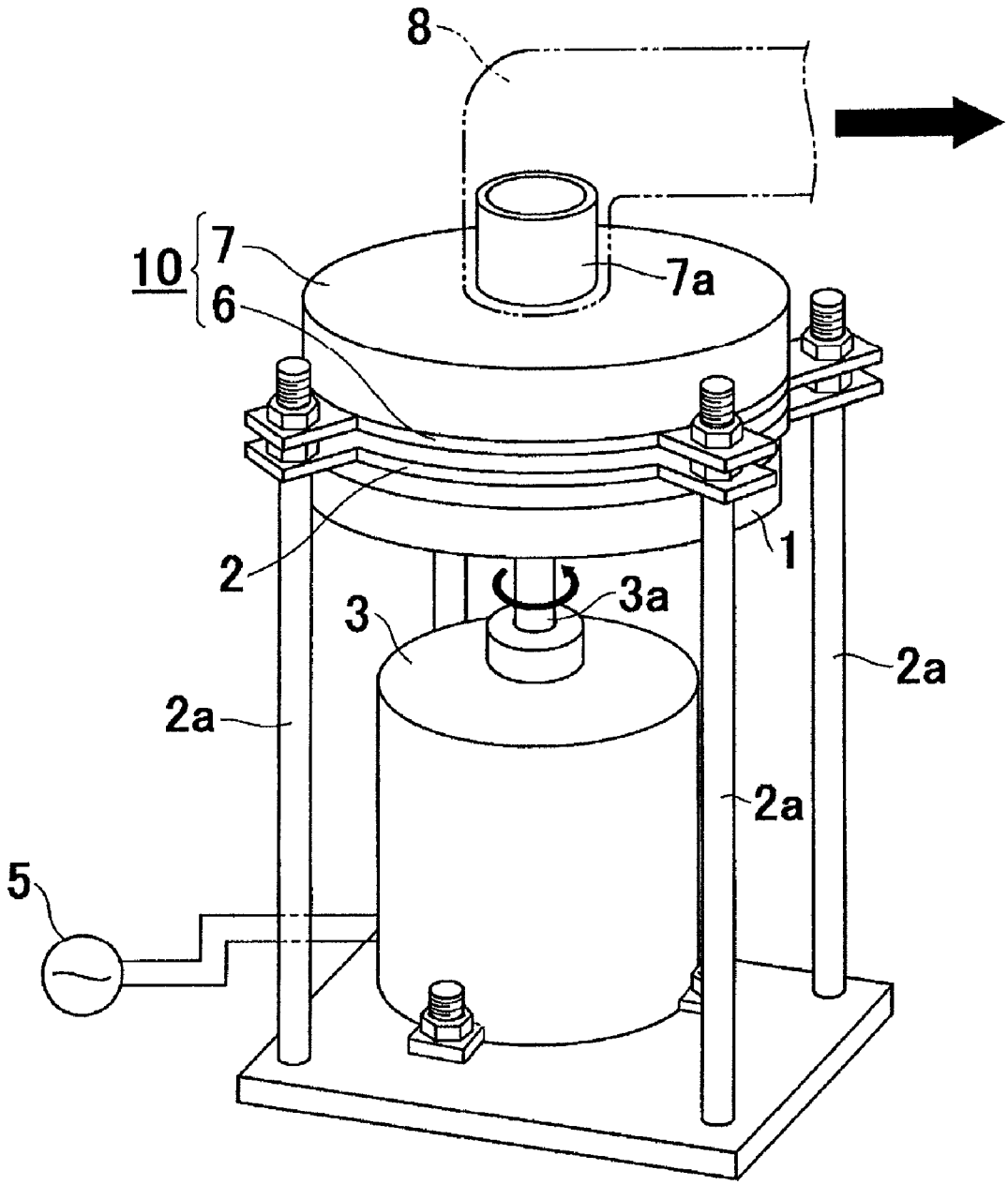
FIG. 3 is a perspective view showing one embodiment of an electromagnetic induction type heating device according to the present invention.
Figure 4A:
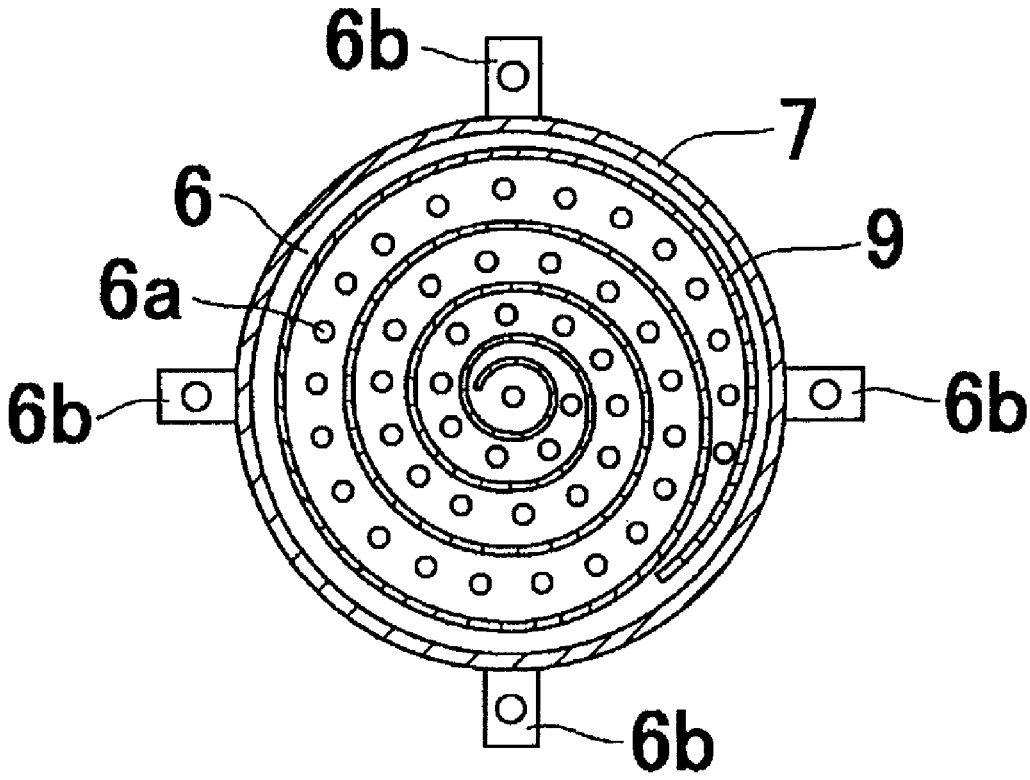
FIG. 4(*a*) is a sectional plan view.
Figure 4B:
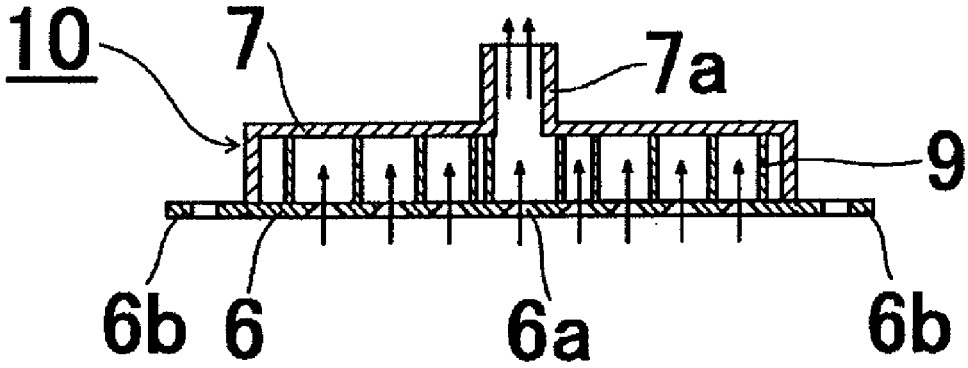

FIG. 3 is a perspective view showing one embodiment of an electromagnetic induction type hot air generating device according to the present invention; and FIG. 4(*a*) is a sectional plan view, while FIG. 4(*b*) is a sectional front view of a hot air capture part.

As shown in FIG. 3, the electromagnetic induction type hot air generating device of the present invention is such that a disk, which is made of aluminum, and serves as the heat generation part 2, is fixed in place in an upright manner above, and in the vicinity of, a planar rotating body 1, on which a plurality of permanent magnets 1*a* as shown in FIG. 2 are fixed in place at arbitrary intervals; and an hot air capture part 10, having substantially the same diameter, is disposed and fixed in place in an upright manner above, and in the vicinity of, this disk, by way of the support legs 2*a*.

Flanges 6*b* are integrally formed with the heat generation part 2 and a hot air capture plate 6 of the hot air capture part 10, at four locations, respectively, protruding from the circumferential edges thereof, the ends of the support legs 2*a* being inserted through the flange parts 6*b*, and fixed in place by way of tightening nuts.

Here, as shown in FIG. 2, the permanent magnets 1*a* are arranged in a circle at uniform intervals around the rotating body 1. The permanent magnets 1*a* may be arranged so that north poles and south poles are alternatingly positioned, or may be arranged so that like poles are adjacent to each other. The number thereof disposed is likewise arbitrary. The rotating body 1 is rotated at high speeds by way of a rotating shaft 3*a*, which is coupled to a motor 3. Note that, in the present embodiment, the power source of the motor 3 is a commercial power source 5 but, as a matter of course, it is advantageous to use natural energy such as solar power, hydroelectric power or wind power as the power source.

The hot air capture part 10 is an device for capturing and collecting the Joule heat generated by the heat generation part 2 and, as shown in FIG. 4, a substantially cylindrical cover 7, which has a hot air exhaust pipe 7*a*, is provided so as to cover the top face of the hot air capture plate 6, which is made of aluminum, in which a plurality of hot air flow passage holes 6*a* have been made. In the present embodiment, the hot air passage holes 6*a* are arranged with the holes in a spiral, and a strip-shaped guide 9 is provided in an upright manner in a spiral shape, following this arrangement. A blower (not shown in the figure) is connected to the hot air exhaust pipe 7*a*, via a duct 8, and the Joule heat generated by the heat generation part 2 is suctioned thereby and collected in the form of hot air.

Here, the hot air flow passage holes 6*a* are formed with tapers that progressively narrow from the hot air inflow end to the outflow end, so as to increase the hot air capture efficiency and the inflow rate. Note that the number of hot air flow passage holes, and the shapes thereof, as well as the positions at which these are provided are arbitrary and, as a matter of course, are not limited by the present embodiment. Furthermore, the heat generation part 2 and the hot air capture part 10 may be made of the same material, so as to combine the two functions.

Furthermore, in the same manner as in Embodiment 1, by connecting a thermocouple 4 to the heat generation part 2, heat energy that would be dissipated to the outside air can be reconverted to electrical energy. As a matter of course, the electric power produced by this thermocouple 4 may be supplied, via a step-up means or the like, as electrical power to be used by the motor 3, and may be used as a power source for other electrical equipment.

The electroconductive material is preferably selected from metals that are good conductors, such as copper, silver, aluminum and stainless steel, which readily generate eddy currents as a result of magnetism.

Preferably, permanent magnets of 3000 gauss or more at the surfaces thereof, such as, for example neodymium magnets or samarium magnets, are used for the permanent magnets. The stronger the magnetism of the permanent magnet, the higher the temperature of the heat generated by the electroconductive material. The permanent magnets are rotated around the electroconductive material at several hundred RPM or more. The strength of the permanent magnets, the number of poles, and the rotational speed are determined according to the amount of heat generation required and the usage. The temperature of the generated heat can easily be adjusted by adjusting the rotational speed of the rotor.

The material for the hot air capture plate is preferably selected from metals that are good conductors, such as copper, silver, aluminum and stainless steel, which readily generate eddy currents as a result of magnetism. Furthermore, the number of hot air flow passage holes and the positions at which these are provided are arbitrary, but it is preferable that these be arranged in a spiral or an involute curve.

The heating device and electrical power generating device of the present invention have the following excellent effects.

(1) Because this is a self-heating device in which the electroconductive material generates heat as a result of the eddy current, the thermal efficiency is good and this is an ecological heat source, which does not generate carbon dioxide. Furthermore, the only electrical power used is that which turns the rotor, and therefore there is little power consumption, and it is possible to keep running costs low.

(2) Because of the simple structure, in which permanent magnets are arranged within the rotor and this is simply rotated in the vicinity the electroconductive material, malfunctions are unlikely and maintenance is easy.

(3) Temperature adjustment is easy, because it suffices to adjust the rotational speed of the rotor.

(4) By connecting a thermocouple to the electroconductive material, heat that would be dissipated can be reused as electrical power, which further improves efficiency.

(5) It is possible to effectively collect the Joule heat generated by the heat generation part, by way of the hot air capture plate, in which a plurality of hot air passage holes are provided.

It is a matter of course that the device of the present invention can be used as a heat source for stoves and water heaters in ordinary households, and it is extremely useful and has a high degree of utility when used as a heating device in heated greenhouses, in the field of agriculture, or as a heat source for incinerators. Furthermore, it is extremely useful and has a high degree of utility, as it can be used as a heat source for residential heating and for melting accumulated snow.

The invention claimed is:

1. An electromagnetic induction device comprising:

a rotationally driven planar rotating body, at an interior of which a permanent magnet is disposed; and a heat generation part that includes an electroconductive material, which is provided disposed in a vicinity of said planar rotating body, and which is disposed within a magnetic field of the permanent magnet.

2. The electromagnetic induction device of claim 1 further comprising a thermocouple connected to the heat generation part thereby to generate electrical power.

3. An electromagnetic induction device comprising:

a rotationally driven planar rotating body, at an interior of which a permanent magnet is disposed; a heat generation part that includes an electroconductive material, said heat generation part being disposed in a vicinity of said planar rotating body and within a magnetic field of the permanent magnet; and a hot air capture plate disposed in a vicinity of said heat generation part and comprising a plurality of hot air flow passage holes.

4. The electromagnetic induction type hot air generating device of claim 3, wherein the hot air flow passage holes are arranged in a spiral.

5. The electromagnetic induction device of claim 3 or claim 4, further comprising a guide on the hot air capture plate for guiding hot air flowing out from the hot air passage holes.

6. The electromagnetic induction type hot air generating device of claim 3 or claim 4, wherein the hot air flow passage holes progressively narrow from a hot air inlet end thereof to an outlet end thereof.

7. The electromagnetic induction type hot air generating device recited in any of claims 3 or claim 4, further comprising a thermocouple connected to the heat generation part.

* * * * *